US011577905B2

(12) United States Patent
Schmidt-Ellinger et al.

(10) Patent No.: US 11,577,905 B2
(45) Date of Patent: Feb. 14, 2023

(54) STORAGE AND DISPENSING STATION FOR DRUGS

(71) Applicant: Becton Dickinson Rowa Germany GmbH, Kelberg (DE)

(72) Inventors: Hardy Schmidt-Ellinger, Gerolstein (DE); Sebastian Josef Michael Illigen, Mehren (DE)

(73) Assignee: BECTON DICKINSON ROWA GERMANY GMBH, Kelberg (DE)

( * ) Notice: Subject to any disclaimer, the term of this patent is extended or adjusted under 35 U.S.C. 154(b) by 464 days.

(21) Appl. No.: 16/815,563

(22) Filed: Mar. 11, 2020

(65) Prior Publication Data

US 2021/0284430 A1 Sep. 16, 2021

(51) Int. Cl.

| | |
|---|---|
| ***B65D 83/04*** | (2006.01) |
| ***A61J 1/03*** | (2006.01) |
| ***A61J 7/00*** | (2006.01) |

(52) U.S. Cl.

CPC ..... *B65D 83/0481* (2013.01); *A61J 1/03* (2013.01); *A61J 7/0076* (2013.01); *B65D 83/0409* (2013.01); *B65D 2583/049* (2013.01); *B65D 2585/56* (2013.01)

(58) Field of Classification Search

CPC ..... A61J 1/03; A61J 7/0076; B65D 83/04; B65D 83/0409; B65D 83/0481; B65D 83/087; B65D 83/0864; B65D 2583/049; B65D 2585/56

See application file for complete search history.

(56) References Cited

U.S. PATENT DOCUMENTS

| | | | | |
|---|---|---|---|---|
| 2,108,902 A * | 2/1938 | Rasmussen | B65D 83/00 | 221/307 |
| 3,162,287 A * | 12/1964 | Lupovici | G07F 11/54 | 221/121 |
| 4,872,591 A * | 10/1989 | Konopka | A61J 7/0481 | 221/129 |
| 5,148,944 A * | 9/1992 | Kaufman | G07F 11/10 | 221/268 |

(Continued)

FOREIGN PATENT DOCUMENTS

EP 2612645 A2 7/2013

OTHER PUBLICATIONS

Extended European Search Report for Application No. 20162376.6, dated Aug. 28, 2020, 13 pages.

*Primary Examiner* — Gene O Crawford
*Assistant Examiner* — Kelvin L Randall, Jr.
(74) *Attorney, Agent, or Firm* — Morgan, Lewis & Bockius LLP

(57) ABSTRACT

A storage and dispensing station for drugs is provided. The storage and dispensing station includes a receiving space for drug portions, the receiving space having a feed section with a base section and a dispensing opening, an ejection device for moving a drug portion through the dispensing opening, the ejection device having a slide which can be moved in the feed section towards the dispensing opening and a slide drive coupled to the slide for moving the slide, as well as a lock which can be moved in the feed section and which can be moved in the feed section such that when a drug portion is moved towards the dispensing opening, movement of drug portions in the feed section is prevented.

19 Claims, 4 Drawing Sheets

(56) References Cited

U.S. PATENT DOCUMENTS

| | | | | | |
|---|---|---|---|---|---|
| 5,152,422 | A * | 10/1992 | Springer | A61J 7/0409 | 221/121 |
| 5,253,782 | A * | 10/1993 | Gates | G07F 11/54 | 221/121 |
| 5,335,816 | A * | 8/1994 | Kaufman | G07F 11/14 | 221/124 |
| 5,605,249 | A * | 2/1997 | Gonyea | G07F 11/54 | 221/121 |
| 6,435,370 | B1 * | 8/2002 | Wilson | G07F 17/0092 | 221/270 |
| 7,107,122 | B1 * | 9/2006 | Whyte | A61J 7/0481 | 221/12 |
| 7,128,997 | B2 * | 10/2006 | Harding | H01M 8/04201 | 221/104 |
| 7,673,772 | B2 * | 3/2010 | Bedore | G07F 17/0092 | 221/69 |
| 2002/0103573 | A1 | 8/2002 | Fellows et al. | | |
| 2004/0168577 | A1 * | 9/2004 | Fischer | A47F 1/085 | 99/275 |
| 2005/0279758 | A1 * | 12/2005 | Umeda | G07D 1/00 | 221/85 |
| 2011/0192863 | A1 * | 8/2011 | Barrass | A61J 7/0084 | 221/92 |
| 2011/0290818 | A1 | 12/2011 | Leifeld et al. | | |
| 2013/0090594 | A1 * | 4/2013 | Palmer | A61J 7/0445 | 604/60 |
| 2016/0287479 | A1 * | 10/2016 | Okutsu | A61J 7/0427 | |

* cited by examiner

STORAGE AND DISPENSING STATION FOR DRUGS

BACKGROUND

The present disclosure relates to a storage and dispensing station for drugs.

SUMMARY

One or more embodiments include a storage and dispensing station for drug portions. The storage and dispensing station includes a receiving space for drug portions to be separated, the receiving space having a feed section adapted to the drug portions to be separated, with a base section and a dispensing opening. The storage and dispensing station also includes an ejection device for moving a drug portion through the dispensing opening, the ejection device having a slide which can be moved in the feed section towards the dispensing opening and a slide drive coupled to the slide for moving the slide. The storage and dispensing station further includes a lock which can be moved in the feed section and which can be moved in the feed section such that when a drug portion is moved towards the dispensing opening, movement of drug portions in the feed section is prevented.

One or more embodiments include a storage and dispensing station for drug portions. The storage and dispensing station includes a receiving trough having an outer dispensing opening and a magazine unit rotatably arranged in the receiving trough. The magazine unit includes a cover and one or more receiving spaces configured to receive drug portions to be separate. Each receiving space includes a feed section, a base section and a dispensing opening. The storage and dispensing station also includes an ejection device having a slide and a lock. The ejection device is configured to move the slide within the feed section towards a receiving space dispensing opening that is rotatably aligned with the outer dispensing opening of the receiving trough, the movement of the slide configured to move a first drug portion through the receiving space dispensing opening and the outer dispensing opening.

The foregoing and other features, aspects and advantages of the disclosed embodiments will become more apparent from the following detailed description and accompanying drawings.

BRIEF DESCRIPTION OF THE DRAWINGS

In the following, the inventive storage and dispensing station for drug portions is described in more detail with reference to the accompanying drawing, in which.

DETAILED DESCRIPTION

Figure 1:
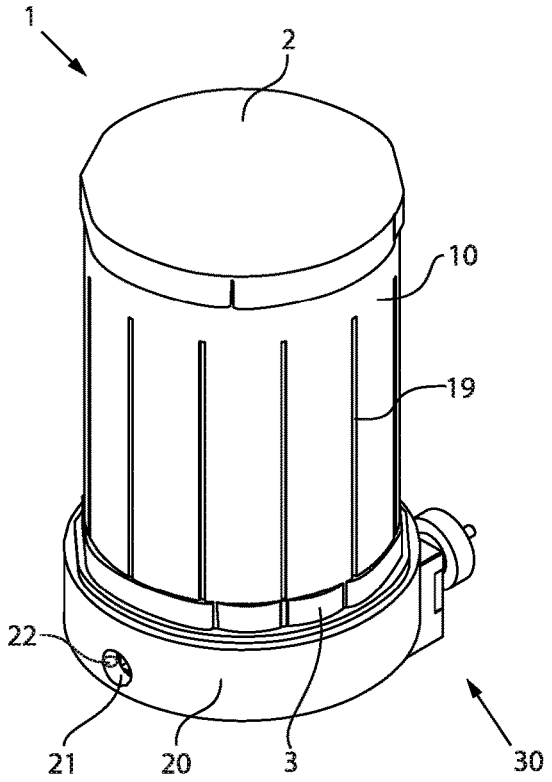
FIG. 1 is a perspective view of one or more embodiments of a storage and dispensing station according to the disclosure.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Depending on the expansion stage, modern blister machines, as disclosed, for example, in WO 2013/034504 A1, comprise several hundred storage and dispensing stations for drugs. In each of these, a plurality of drug portions of a particular drug type is stored, and individual or a plurality of drug portions can be dispensed on demand. With the blister machine, the drugs stored in the storage and dispensing stations are compiled and blistered patient-specifically according to the medically prescribed administration times.

For the assembly of the drug portions, corresponding storage and dispensing stations are actuated for dispensing one or more individual drug portions. When actuating a storage and dispensing station, a single drug portion is separated with a singulator and transferred to a guide device of the blister machine via a dispensing opening. By means of the guide device, a corresponding drug portion, optionally with the interposition of a collecting device, is fed to a packaging device which blisters individual or multiple drug portions according to the medical requirements.

The singulator of known storage and dispensing stations used for separating drug portions is usually designed in the shape of a circular cylinder and is formed in a corresponding guide space of the storage container. A plurality of drug channels is provided on the circumference of the singulator. By rotating the singulator, a drug channel loaded with at least one drug portion is rotated over a dispensing opening in the bottom surface of the storage container, so that the drug portion located in the channel can fall out of the drug channel. A retention device is provided above the drug channel aligned at the dispensing opening, in order to prevent further drug portions arranged above the drug channel from slipping down, said drug channel being aligned at the dispensing opening. Depending on the type of drug to be separated, it can also be provided that this retention device is guided in a slot which is introduced into the singulator in the region of the drug channels.

Due to the rotation of the singulator used and the friction of the drug portions against one another and against the separating device, drug dust is generated, which makes regular cleaning of the storage and dispensing station necessary.

In the case of capsule-shaped drug portions in particular, the delivery speed is problematic when using known singulators. Capsule-shaped drug portions are regularly very light, in addition there is an increased friction between the surface of the drug portions and the drug channels. Furthermore, there is an electrostatic charge on the capsules, in particular in the case of capsule-shaped drug portions, as a result of which an attraction to the drug channel wall arises. Taken together, these circumstances cause capsule-shaped drug portions to drop out of the drug channel so slowly that the blistering speed of modern blister machines is restricted.

It is an object of the present disclosure to provide a storage and dispensing station with which all types of drug portions can be dispensed quickly and with a reduced development of drug dust.

The storage and dispensing station according to the disclosure comprises a receiving space for drug portions to be separated, the receiving space having a feed section with a bottom portion and a dispensing opening adapted to the drug portions to be separated. The feed section ensures that only a defined number of drug portions rests on the bottom section. In order to achieve this, the feed section is adapted to the shape of the drug portions to be separated. The receiving space arranged above the feed section can be designed differently depending on the drug portions to be separated. If, for example, spherical drug portions are to be separated, the receiving space can expand conically upwards. If, on the other hand, for example, capsule-shaped drug portions are to be separated, it can be provided that the shape of the receiving space is the same as that of the feed section.

The storage and dispensing station according to the disclosure further comprises an ejection device for moving a drug portion in the ejection direction through the dispensing opening, the ejection device having a slide which can be moved in the feed section towards the dispensing opening and a slide drive coupled to the slide for moving the slide. In contrast to the case with storage and dispensing stations according to the prior art, in which the drug portions are delivered by gravity, an active ejection device is provided according to the disclosure. In such a case, it is necessary to provide a drive that is necessary to eject the drug portions, but in such a case, significantly higher dispensing speeds can also be achieved with otherwise rather "slowly" falling drug portions. Since no rotating singulator is used for separating and dispensing drug portions, significantly less drug dust is generated and the storage and dispensing station has to be cleaned less frequently.

In order to prevent that the drug portion arranged above the drug portion that was just dispensed is moved into the free space of the feed section during the process of ejecting or dispensing a drug portion, which could possibly prevent the slide from moving back, the storage and dispensing station also includes a lock that is movable in the feed section, which is movable in the feed section in such a way that when a drug portion is moved toward the dispensing opening, the movement of drug portions in or into the feed section is prevented. For this purpose, the lock itself can be moved completely within the feed section; alternatively, it is also conceivable that the movable lock is moved into or over the feed section via an opening in or above the feed section in such a way that a drug portion is prevented from slipping down.

Another advantage of the storage and dispensing station according to the disclosure is that, due to the unnecessary singulator, more space is available for receiving drug portions.

In the storage and dispensing station according to the disclosure, a slide is provided for moving a drug portion to be dispensed and a lock for preventing a drug portion from slipping. These two components can be separate components that can be moved using different drives. In order to keep the structure of the storage and dispensing station according to the disclosure as simple as possible, it is provided in one or more embodiments that the slide and the lock are coupled in such a way that both can be moved via the slide drive provided according to the disclosure. A correspondingly synchronous movement is possible, since the lock must be moved when the slide is moved. In order to further simplify the construction of the storage and dispensing station according to the disclosure, it is provided in one or more embodiments that the slide and the lock are designed as a uniform slide-lock element, this slide-lock element preferably being formed in one piece, for example as a kind of bolt, in which the end face serves as a slide and the "upper" peripheral section as a lock.

Due to the use of an active ejection device, it is relatively unlikely that no drug portion will be dispensed when the slide is moved. However, in order to detect even the unlikely event that no drug portion is dispensed when the slide is moved, it is provided in one or more embodiments that the dispensing opening is assigned a sensor which can detect the dispensing of a drug portion through the dispensing opening.

The use of the active ejection device enables a quick dispensing of a drug portion for all types of drug portions, with a simultaneous reduction in the development of drug dust. In the event that several drug portions of the same type of drug are to be dispensed and only one storage and dispensing station is provided for this type of drug, the rate at which a drug portion slides into or in the feed section determines how quickly another drug portion can be dispensed. In the case of capsule-shaped drug portions in particular, this means that although the first drug portion can be dispensed quickly, the dispensing of the second drug portion from the same storage and dispensing station takes place only at a reduced speed (for the reasons mentioned above). In order to also further increase the dispensing speed of a plurality of drug portions, it is provided in one or more embodiments that the storage and dispensing station has a plurality of feed sections with a base section and a dispensing opening, wherein each feed section can be coupled to the ejection device for dispensing a drug portion. For this purpose, it is conceivable, for example, that the feed sections are moved in relation to the slide, in other words, that a different feed section is fed to the slide after dispensing a drug portion.

In order to realize the use of a plurality of feed sections in a structurally space-saving manner, it is provided in one or more embodiments that the plurality of feed sections is arranged in a rotatable magazine unit, the magazine unit being coupled to a magazine compartment drive in such a way that the magazine unit is rotated after dispensing a drug portion out of one feed section such that a drug portion can be dispensed from another feed section.

The rotating movement of the magazine unit can be carried out by a special, very responsive drive. It can thus be achieved that drug portions can be dispensed more quickly than it can be achieved by "waiting" for a drug portion to slide down after dispensing the previous portion of medication. In order to avoid the use of several drives, it is provided in one or more embodiments of the storage and dispensing station according to the disclosure that the slide drive comprises an actuator coupled to the magazine unit, the coupling being designed such that a rotary movement of the magazine unit is effected after dispensing a drug portion.

With typical storage and dispensing stations, it is necessary for the drug channels to be adapted to the drug portions to be separated. Also in the storage and dispensing station according to the disclosure, it is necessary that the feed section is adapted to the shape and size of the drug portions to be separated when separating drug portions. In order to reduce the downtime of a storage and dispensing station when refilling drug portions and to simplify adaptation of the storage and dispensing station to differently shaped drug portions, it is provided in one or more embodiments that the magazine unit is interchangeably arranged in the storage and dispensing station.

The magazine unit will regularly be empty when changing. However, it can happen that a magazine unit is changed before all drug portions have been dispensed (e.g., when the picking device is stopped in the evening). In order to avoid that drug portions fall out of the dispensing openings when a non-empty magazine unit is removed out of or from the storage and dispensing station or when a full magazine unit is inserted, it is provided in one or more embodiments that the storage and dispensing station has a security device which is guided on the circumference of the magazine unit and which blocks the dispensing openings when the magazine unit is removed.

In the storage and dispensing station according to the disclosure, the speed at which the slide moves a drug portion out of the dispensing opening largely determines the overall speed at which the storage and dispensing station can dispense drug portions. In one or more embodiments it is provided that the slide drive comprises a lifting magnet. A lifting magnet is structurally very simple and can be controlled extremely quickly. Furthermore, a very high ejection speed and force can be achieved with a lifting magnet.

The picking device, in which the storage and dispensing stations according to the disclosure are used, knows the fill level of these stations precisely and notifies a user if refilling is necessary within a defined period. However, it has been found that users wish that the fill level can also be read optically. This can be achieved, for example, by producing the area in which the drug portions are stored from a transparent material. However, since this is possibly associated with some disadvantages (e.g., in the manufacture of the storage and dispensing stations), it is provided in one or more embodiments that the receiving space and the feed section or sections have a viewing area which allows the fill level to be read. This viewing area can, for example, simply be designed as a slot in the wall of the receiving space if the type of drug to be separated does not tend to form dust. As another example, a transparent material can be used only in this area or can be inserted into a slot.

One or more embodiments of a storage and dispensing station 1 according to the disclosure is described in more detail below. One or more embodiments described here are adapted for capsule-shaped drug portions 7. The storage and dispensing station 1 according to the disclosure shown in FIG. 1 comprises a receiving trough 20 with an outer dispensing opening 21, in which a sensor 22 for detecting the ejection of a drug portion 5 through the outer dispensing opening 21 is arranged. A magazine unit 10, which is closed with a cover 2, is rotatably arranged in the receiving trough 20. An ejection device 30 is arranged below the receiving trough 20 and is described in more detail with reference to the following figures.

Figure 2:
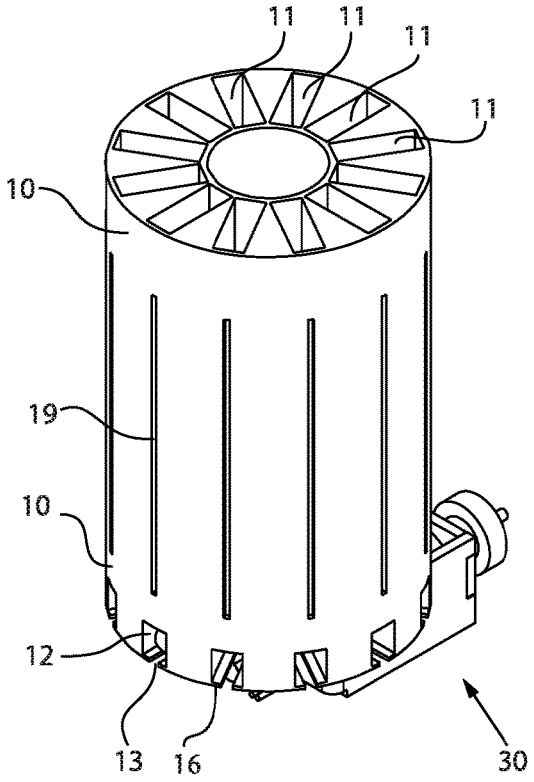
FIG. 2 is a perspective view of one or more embodiments of a storage and dispensing station, with some outer components omitted to illustrate internal components.
Figure 3:
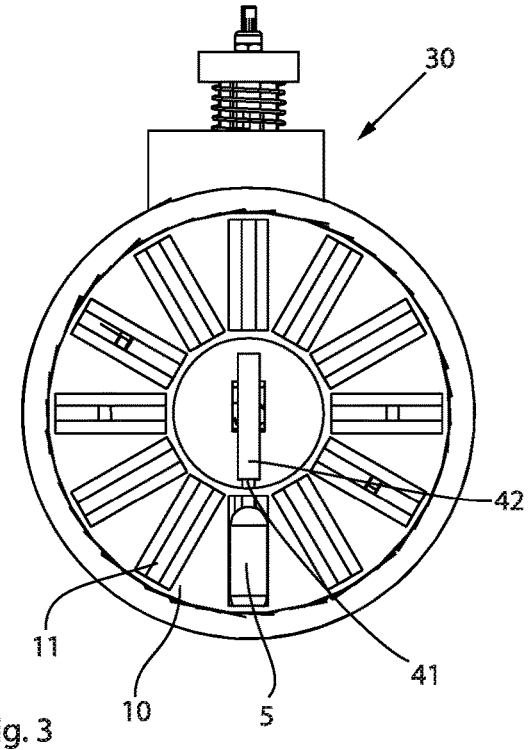
FIG. 3 is a top view of the storage and dispensing station of FIG. 2 without a cover.

As can be seen in FIGS. 2 and 3, the magazine unit 10 comprises a plurality of vertical receiving spaces 11, which may be designed to receive drug capsules 7. Each receiving space 11 comprises a feed section 15 with a base surface 16 having a recess 13, and a dispensing opening 12. Here, the dispensing openings 12 of the magazine unit 10 are aligned with the outer dispensing opening 21. In one or more embodiments without a magazine unit 10, the receiving trough 20 and thus the outer dispensing opening 21 may be omitted. The sensor 22 may then be arranged directly at a dispensing opening 12. Each of the receiving spaces 11 shown comprises a viewing area 19 for determining the fill level of the receiving space 11. The viewing area 19 may be designed as a simple slot, since the capsule-shaped drug portions 7 to be separated do not tend to form dust.

Furthermore, a securing device 3 is indicated around the magazine unit 10, which is designed as a simple ring which abuts against the outer wall of the magazine unit 10. If the magazine unit 10 is removed from the receiving trough 20, the securing device 3 slides down and blocks the dispensing openings 12 of the magazine unit 10.

Figure 4:
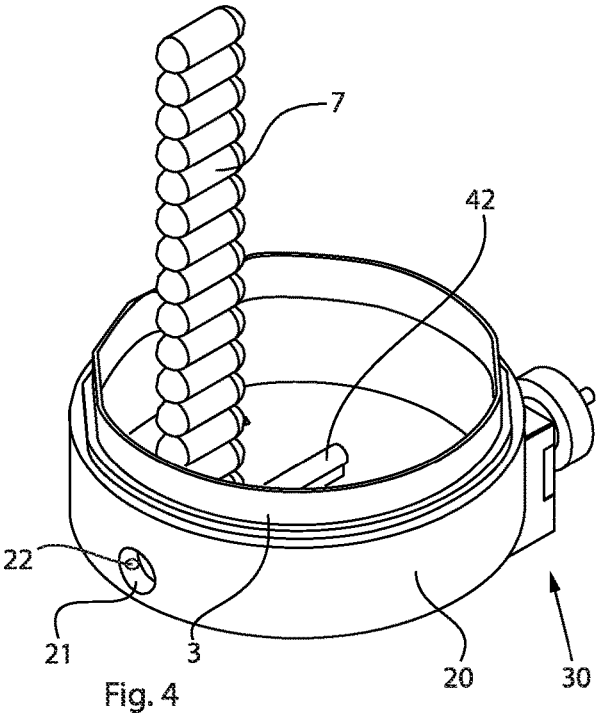
FIG. 4 is a perspective view of the storage and dispensing station of FIG. 2 without a magazine unit.

The magazine unit 10 is omitted in the illustration according to FIG. 4, and the arrangement of the drug portions 7 in a receiving space 11 or feed section 15 is shown. The capsule-shaped drug portions 7 are stored in the receiving spaces 11 in the same way as in a magazine. When the lower drug portion 5 is ejected, the overlying drug portions 7 slip down when released, as can be seen in the following figures.

Figure 5:
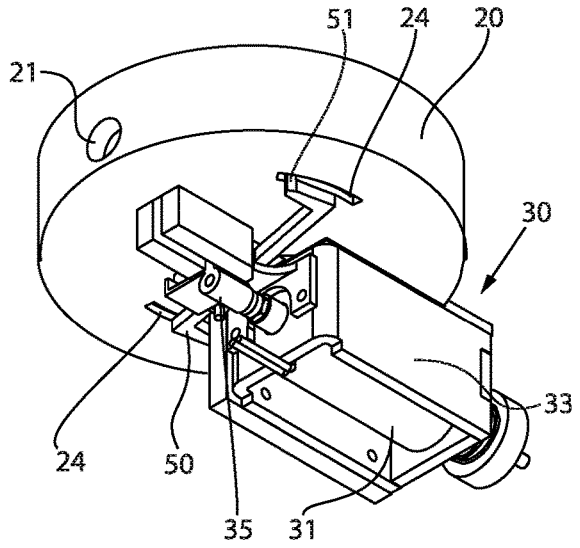
FIG. 5 is another perspective view of the storage and dispensing station of FIG. 2 without a magazine unit.
Figure 6:
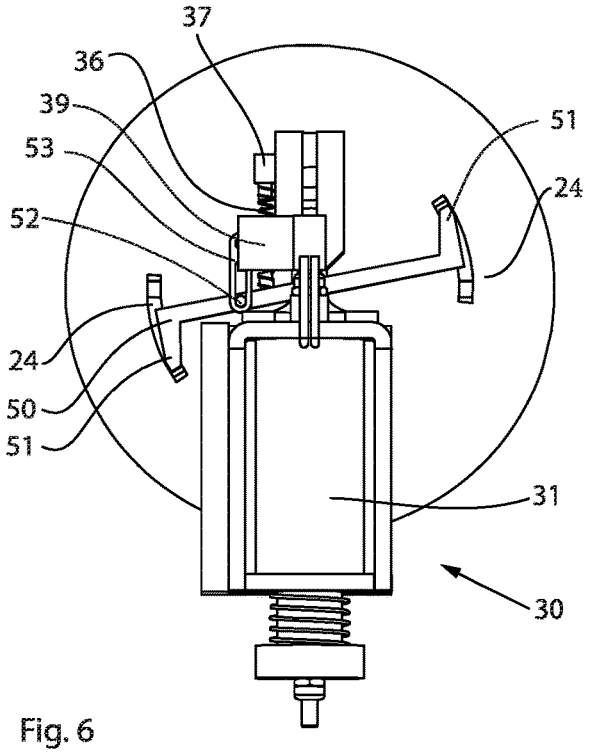
FIG. 6 is a bottom view of the storage and dispensing station of FIG. 2.
Figure 7A:
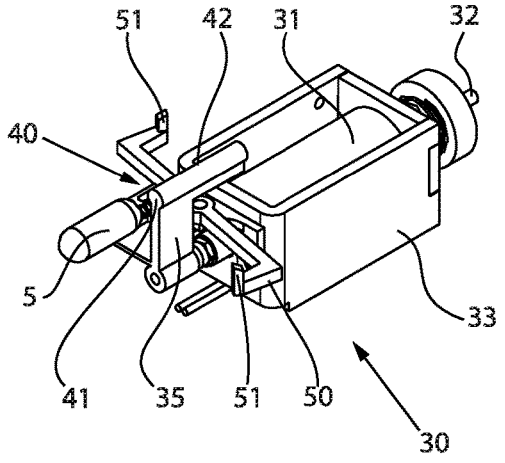
FIGS. 7*a* and 7*b* are perspective views of an ejection device in combination with a slide-lock element.
Figure 7B:
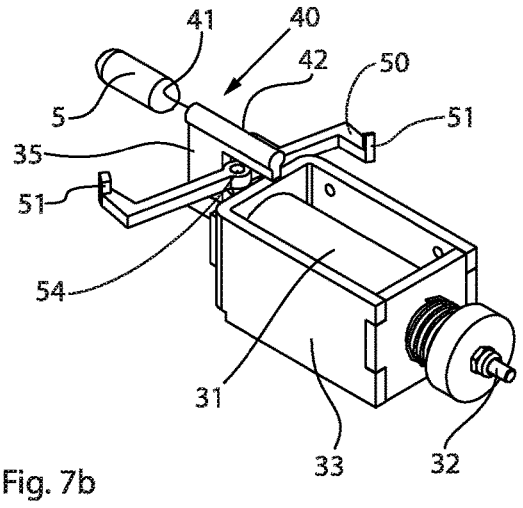

The ejection device 30 is shown in FIG. 5. In one or more embodiments, a lifting magnet 31, 32 is arranged in a housing 33, which is coupled via a coupling piece 35 to a slide-lock element 40, as shown in FIGS. 7*a* and 7*b*. The coupling piece 35 is also coupled to an actuator 50 that has two extensions 51, which are guided through openings 24 in the bottom surface of the receiving trough 20. As can be seen in FIG. 6, which shows a view from below, the actuator 50 is pre-tensioned with a spring 36 which is supported against a stop 37. When the actuator (in FIG. 6) moves "upward," the spring 36 is tensioned further so that the spring 36 can cause the actuator 50 to move back. In one or more embodiments, the actuator 50 is coupled to a web 39 of the coupling piece 35 by means of a driver 53, which accommodates a nose 52 of the actuator 50 in an elongated hole.

FIGS. 7*a* and 7*b* show detailed views of the ejection device 30 and the slide-lock element 40. The slide-lock element 40 is coupled to the lifting magnet 31, 32 via a coupling piece 35. The slide-lock element 40 comprises a slide 41 and a lock 42, the slide 41 being formed by the end face of the slide-lock element 40 and the lock 42 by the upper surface of the bolt-shaped slide-lock element 40.

The mode of operation of the storage and dispensing station 1 according to the disclosure can be seen from FIGS. 7*a* and 7*b*, which show the ejection device 30 in its starting or resting position. When the ejection device 30 is actuated, the slide-lock element 40 is moved over the coupling piece 35, as a result of which the slide 41 ejects the lower drug portion 5. By coupling with the actuator 50, the same is also moved, thereby allowing the movement of the magazine unit 10 (not shown here) after the coupling piece 35 has been returned. FIGS. 5-7*b* show that the actuator 50 may have a central pivot point 54 about which the actuator 50 is rotated when the coupling piece 35 moves.

Figure 8:
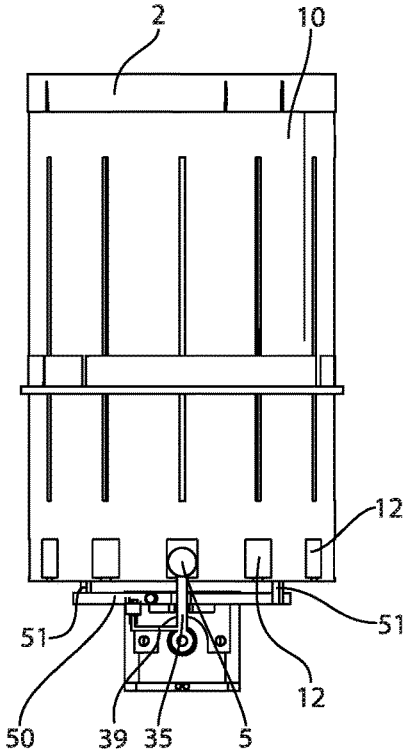
FIG. 8 is a front view of the storage and dispensing station of FIG. 2.

FIG. 8 shows a frontal view of one or more embodiments with the receiving trough 20 omitted. The arrangement of the actuator 50 below the magazine unit 10 can be seen in FIG. 8. It can also be clearly seen that the extensions 51 of the actuator 50 protrude "upward" and thus make contact and rotation of the magazine unit 10 possible. In one or more embodiments, the magazine unit 10 may be rotated by a drive (not shown) that is completely decoupled from the ejection device 30.

Figure 9:
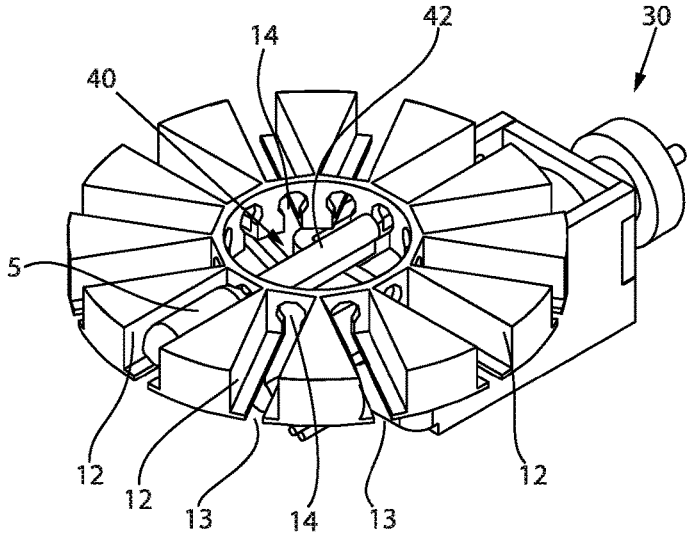
FIG. 9 is a perspective horizontal sectional view of the storage and dispensing station of FIG. 2.

FIG. 9 shows a sectional view through the lower section of the magazine unit 10. In one or more embodiments, the magazine unit 10 has an inner cavity, in which the slide-lock element 40 is arranged. A drug portion 5 is ejected by moving the slide 41 (or the slide-lock element 40) through an opening 14 in the feed section 15. Since the slide-lock element 40 here is coupled by means of the coupling piece 35 to a slide drive (e.g., lifting magnet 31, 32) arranged below the receiving trough 20, the bottom surface of the magazine unit 10 has a recess 13 through which the coupling piece 35 can be moved. In one or more embodiments, it is conceivable for the slide 41 to be guided completely in the feed section 15. In such a case, the lock 42 is designed as an independent component, which can then also be inserted laterally into the feed section 15, for example.

Figure 10A:
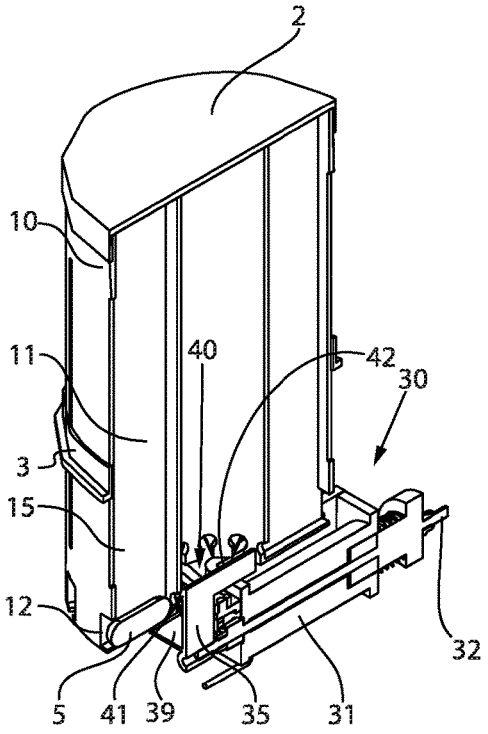
FIGS. 10*a* and 10*b* are perspective and side vertical sectional views of the storage and dispensing station of FIG. 2.
Figure 10B:
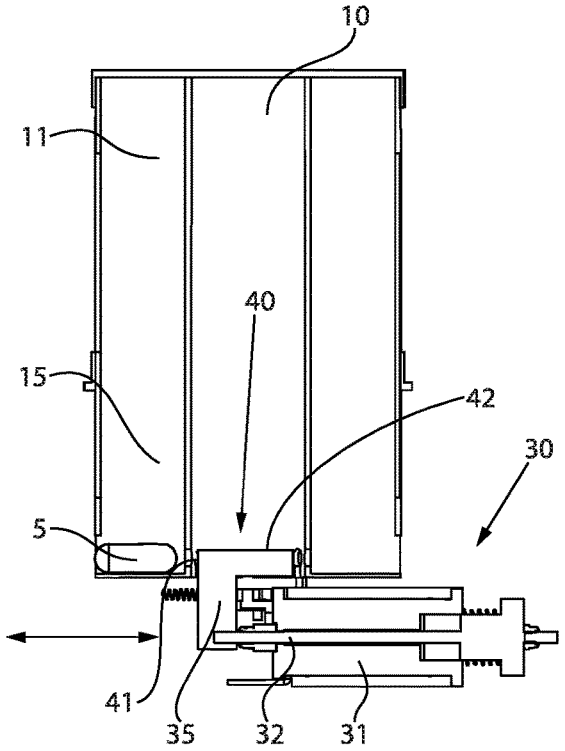

FIGS. 10*a* and 10*b* show the exact design of the ejection device 30 of one or more embodiments. The ejection device 30 comprises a "push type" lifting magnet 31, 32, which has an immovable outer part 32 (e.g., the armature) and an inner movable component 31 (e.g., an electric coil). When the lifting magnet 31, 32 is activated, the armature 32 is moved into the electrical coil 31, as a result of which the coupling piece 35 is moved radially outward. This movement pushes the slide-lock element 40 through the opening 14 in the feed section 15, as a result of which the drug portion 5 is ejected from the dispensing opening 12. Due to the design of the slide-lock element 40, the lock 42, which is formed by the upper wall of the bolt-like slide-lock element 40, simultaneously moves into the feed section 15, thereby preventing any overlying drug portions 7 from slipping down.

Figure 11B:
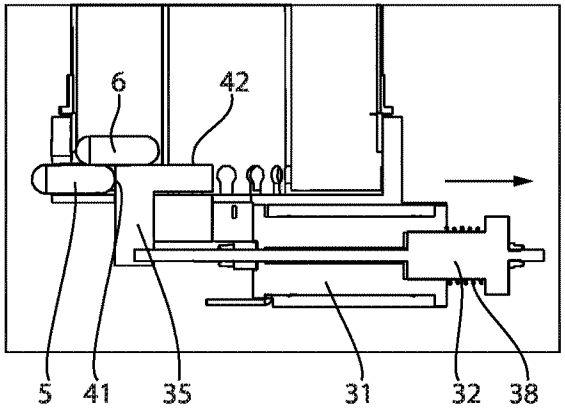
FIGS. 11*a* and 11*b* are detailed partial views of the storage and dispensing station of FIGS. 10*a* and 10*b;*
Figure 11A:
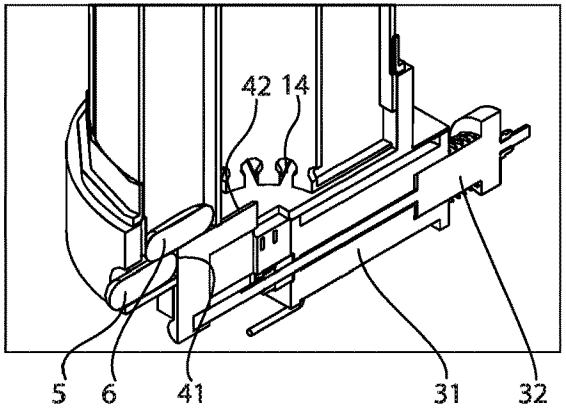

FIGS. 11*a* and 11*b* show sectional views of the lower section of one or more embodiments of the storage and dispensing station 1 with active lifting magnets 31, 32. When the armature 32 of the lifting magnet 31, 32 is extended, a return spring 38 is tensioned, which moves the front section of the armature 32 back into the electric coil 31 when the magnet 31, 32 is deactivated. The slide-lock element 40 is partially moved into the feed section 15 via the coupling piece 35 coupled to the armature 32, so that the drug portion 6 lying thereon cannot slip and possibly tilt. The spring 38, which is tensioned when the lifting magnet 31, 32 is activated, presses the armature 32 out of the electric coil 31 of the lifting magnet 31, 32 when the lifting magnet 31, 32 is deactivated. At the same time, the slide-lock element 40 is also moved due to the coupling by means of the coupling piece 35 from the feed section 15 into the cavity of the magazine unit 10.

Figure 12:
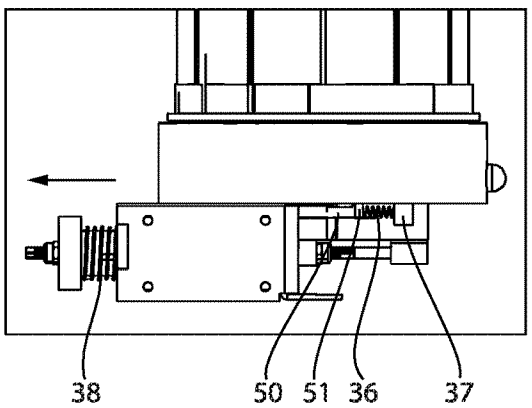
FIG. 12 shows a detailed partial side view of the storage and dispensing station of FIG. 2.
Figure 13B:
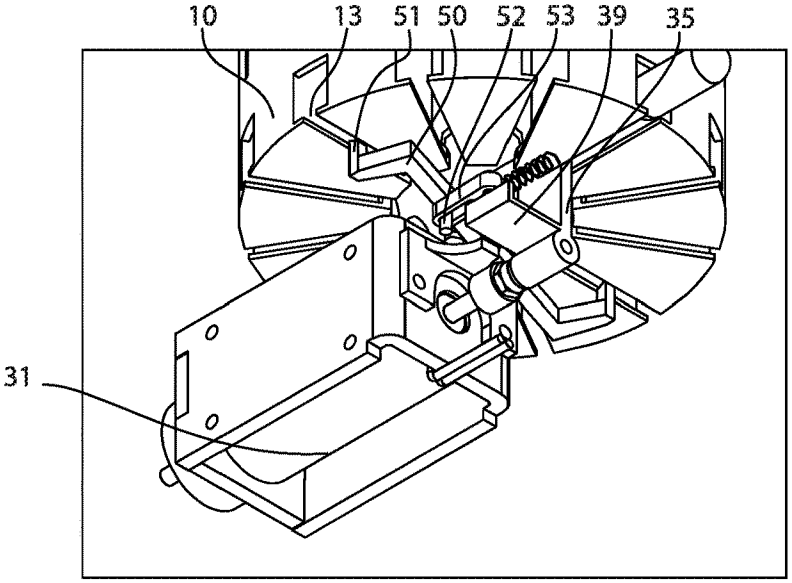
FIGS. 13*a* and 13*b* are detailed perspective views from below of the storage and dispensing station of FIG. 2, the receiving trough for the magazine unit being omitted in FIG. 13*b*.
Figure 13A:
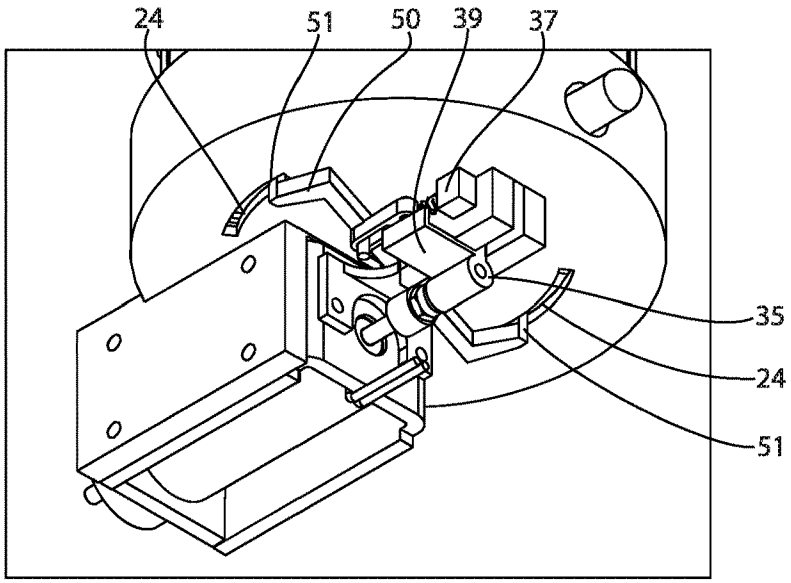

FIGS. 13*a* and 13*b* show the position of FIGS. 11*a*, 11*b* and 12 from below, the receiving trough 20 being omitted in FIG. 13*b*. As soon as the lifting magnet 31, 32 is deactivated, the armature 32 is pulled back into the electrical coil 31. By coupling with the slide-lock element 40, the armature 32 is pulled out of the feed section 15. As soon as the armature 32 is moved out of the feed section 15, the magazine unit 10 can be rotated so that the "next full" feed section 15 is rotated toward the slide-lock element 40. In one or more embodiments, this is done by the actuator 50, the two extensions 51 of which engage in the recesses 13 of the base surfaces 16. As soon as the actuator 50 is "released" via the web 39 and the driver 53, the spring 36 that is tensioned by means of the previous movement of the actuator 50 can move the actuator 50 into its starting position. Due to the engagement of the extensions 51 in the recesses 13, the magazine unit 10 is rotated (counterclockwise in the FIGS. 13*a*, 13*b*).

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

The invention claimed is:

1. A storage and dispensing station for drug portions, comprising:

a receiving trough having an outer dispensing opening;

a magazine unit rotatably arranged in the receiving trough, the magazine unit comprising;

a cover; and one or more receiving spaces configured to receive drug portions to be separated, each receiving space comprising:

a feed section;

a base section; and a dispensing opening; and an ejection device comprising:

a slide;

a lock; and a slide drive comprising an actuator coupled to the magazine unit by a coupling piece, the coupling piece configured to effect rotary movement of the magazine unit after dispensing a first drug portion, wherein the actuator comprises one or more extensions, each extension configured to be guided through an opening in a bottom surface of the receiving trough and to engage with a recess in a bottom surface of the magazine unit, wherein the ejection device is configured to move the slide within the feed section towards a receiving space dispensing opening that is rotatably aligned with the outer dispensing opening of the receiving trough, the movement of the slide configured to move a first drug portion through the receiving space dispensing opening and the outer dispensing opening, and wherein the slide and the lock comprise a unitary slide-lock element configured to be moved by the slide drive.

2. The storage and dispensing station of claim 1, wherein the dispensing opening is assigned a sensor which can detect a dispensing of a drug portion through the dispensing opening.

3. The storage and dispensing station of claim 1, wherein the storage and dispensing station has a plurality of feed sections, each with a corresponding base section and a corresponding dispensing opening, wherein each feed section can be coupled to the ejection device for dispensing a drug portion.

4. The storage and dispensing station of claim 3, wherein the plurality of feed sections is arranged in a rotatable magazine unit, the magazine unit being coupled to a magazine compartment drive in such a way that the magazine unit is rotated out of one feed section after dispensing a drug portion such that a drug portion can be dispensed from another feed section.

5. The storage and dispensing station of claim 4, wherein the magazine unit is interchangeably arranged in the storage and dispensing station.

6. The storage and dispensing station of claim 1, wherein one of the receiving space has a viewing area that allows for reading a fill level and the feed section has a viewing area that allows for reading the fill level.

7. The storage and dispensing station of claim 1, wherein the ejection device is configured to move the lock into a position within the feed section to block movement of other drug portions in the feed section.

8. The storage and dispensing station of claim 1, wherein the slide drive is a lifting magnet.

9. The storage and dispensing station of claim 1, further comprising a securing device configured to be guided on a circumference of the magazine unit, wherein the magazine unit is removable and the securing device is configured to block the receiving space dispensing openings when the magazine unit is removed.

10. A storage and dispensing station for drug portions, comprising:

a receiving trough having an outer dispensing opening;

a magazine unit rotatably arranged in the receiving trough, the magazine unit comprising;

a cover; and one or more receiving spaces configured to receive drug portions to be separated, each receiving space comprising:

a feed section;

a base section; and a dispensing opening; and an ejection device comprising:

a slide;

a lock; and a slide drive comprising an actuator coupled to the magazine unit by a coupling piece, the coupling piece configured to effect rotary movement of the magazine unit after dispensing a first drug portion, wherein the actuator is pre-tensioned by a spring, and wherein the actuator is coupled to a web of the coupling piece, wherein the ejection device is configured to move the slide within the feed section towards a receiving space dispensing opening that is rotatably aligned with the outer dispensing opening of the receiving trough, the movement of the slide configured to move a first drug portion through the receiving space dispensing opening and the outer dispensing opening, and wherein the slide and the lock comprise a unitary slide-lock element configured to be moved by the slide drive.

11. The storage and dispensing station of claim 10, wherein the ejection device is configured to move the lock into a position within the feed section to block movement of other drug portions in the feed section.

12. The storage and dispensing station of claim 10, wherein the slide and the lock comprise a unitary slide-lock element configured to be moved by the slide drive.

13. The storage and dispensing station of claim 12, wherein the slide drive is a lifting magnet.

14. The storage and dispensing station of claim 10, further comprising a securing device configured to be guided on a circumference of the magazine unit, wherein the magazine unit is removable and the securing device is configured to block the receiving space dispensing openings when the magazine unit is removed.

15. The storage and dispensing station of claim 10, wherein the dispensing opening is assigned a sensor which can detect a dispensing of a drug portion through the dispensing opening.

16. The storage and dispensing station of claim 10, wherein the storage and dispensing station has a plurality of feed sections, each with a corresponding base section and a corresponding dispensing opening, wherein each feed section can be coupled to the ejection device for dispensing a drug portion.

17. The storage and dispensing station of claim 16, wherein the plurality of feed sections is arranged in a rotatable magazine unit, the magazine unit being coupled to a magazine compartment drive in such a way that the magazine unit is rotated out of one feed section after dispensing a drug portion such that a drug portion can be dispensed from another feed section.

18. The storage and dispensing station of claim 17, wherein the magazine unit is interchangeably arranged in the storage and dispensing station.

19. The storage and dispensing station of claim 10, wherein one of the receiving space has a viewing area that allows for reading a fill level and the feed section has a viewing area that allows for reading the fill level.

* * * * *